US006030206A

United States Patent [19]

Shizukuisha et al.

[11] Patent Number: 6,030,206

[45] Date of Patent: Feb. 29, 2000

[54] LEAK PREVENTIVE STRUCTURE FOR A CASE OF A SURFACE COMBUSTION BURNER

[75] Inventors: Shin Shizukuisha, Tokyo; Yoshihisa Iseda, Kuki, both of Japan

[73] Assignee: Tokyo Gas Co., Ltd., Tokyo, Japan

[21] Appl. No.: 09/143,442

[22] Filed: Aug. 28, 1998

[51] Int. Cl.[7] ..... F23D 14/12

[52] U.S. Cl. ..... 431/328

[58] Field of Search ..... 431/328, 329

[56] References Cited

U.S. PATENT DOCUMENTS 4,157,155 6/1979 Smith ..... 431/328
4,604,054 8/1986 Smith ..... 431/328
4,605,369 8/1986 Buehl ..... 431/328

*Primary Examiner*—Carroll Dority
*Attorney, Agent, or Firm*—Townsend & Banta

[57] ABSTRACT

Leak preventive structures for cases of flatly installed surface combustion burners, circularly installed cylindrical combustion burners, circularly installed surface combustion burners, circularly installed cylindrical surface combustion burner and a surface combustion burner are provided. Burner elements are composed of fire resistant porous fiber mats are provided wherein the burner element itself may form a peripheral wall of a case of a burner. The walls of the cases of the burners are composed of either ceramic fibers coated or impregnated with sealants to keep the ceramic fibers gas-tight, metallic sheets provided with means for preventing thermal expansion, or a combination of the two.

20 Claims, 12 Drawing Sheets

LEAK PREVENTIVE STRUCTURE FOR A CASE OF A SURFACE COMBUSTION BURNER

FIELD OF THE INVENTION

The present invention relates to a leak preventive structure for a case of a surface combustion burner using a fiber mat obtained by forming metallic or ceramic fibers as a mat or a ceramic mat, etc., as the burner element, which prevents the leak of fuel and combustion air from any other portions than the combustion face of the burner.

SUMMARY OF THE INVENTION

The first embodiment of the present invention provides a leak preventive structure for a case of flatly installed surface combustion burner. In this embodiment, a fiber mat as a burner element is flatly installed in a case having lateral walls formed by ceramic fibers and an open face. The fiber mat is fire resistant and porous. The lateral walls of the case are impregnated with a sealant on the surfaces facing the inside of the case before operation. The ceramic fibers forming the lateral walls of the case, and any other walls of the case, may be partially or entirely covered on the surface facing the inside of the case with a metallic sheet, and coated with a sealant on the portions not covered by the metallic sheet. The metallic sheet may be provided with a means for preventing thermal expansion, such as a thermal expansion absorbing means.

In this first embodiment, the regions of the flatly installed surface combustion burner surrounding the portions of the burner where the burner element is attached are covered with ceramic fiber.

The second embodiment of the present invention provides a leak preventive structure for a case of a circularly installed cylindrical surface combustion burner. In this embodiment, ceramic fibers are used to form the top and bottom of a case with at least one vertical cylindrical or prismatic space in the case. A fiber mat as a burner element is immobilized along the peripheral wall of the space, and may form the peripheral wall of the case. As in the first embodiment, the fiber mat is fire resistant and porous. The top and bottom of the case are impregnated with a sealant on the surfaces before operation for keeping the case gas-tight at all portions of the burner other than the burner element. The ceramic fibers forming the top and bottom of the case, and any other walls of the case including the surface facing the cylindrical or prismatic space formed at or near the center of the case, may be partially or entirely covered on the surface facing the inside of the case with a metallic sheet for keeping the case gas-tight at all portions of the burner other than the burner element, and coated with a sealant on the portions not covered by the metallic sheet. The peripheral wall of the cylindrical or prismatic space may be coated with a sealant on surfaces facing the inside of the case. As in the first embodiment, the metallic sheet may be provided with a means for preventing thermal expansion.

In addition, in the second embodiment of the present invention as described above, the peripheral wall of the case may be formed by at least one metallic sheet, which extends to the top and bottom of the case and also to the burner element attaching portions. The burner element and the extended metallic sheet are fastened at burner element attaching portions by clamping means from the cylindrical or prismatic side, and the clamping means are covered, at their outside ends, with the top and bottom of the case formed by ceramic fibers, with a space kept between clamping means and the top and bottom, respectively.

In the third embodiment of the present invention, a leak preventive structure for a case of a circularly installed cylindrical surface combustion burner is provided, which is similar to the above embodiment. However, the peripheral wall of the cylindrical or prismatic space is formed by at least one metallic sheet, the burner element is installed as the peripheral wall of the case, and the top and bottom of the case are coated with at least one metal sheet on the surfaces facing the inside of the case, on the surfaces facing the cylindrical or prismatic space formed at or near the center of the case, and also on the outside peripheral surfaces of the case.

A fourth embodiment of the present invention provides a leak preventive structure for a case of a circularly installed cylindrical surface combustion burner, which is similar to the third embodiment described above. However, this embodiment provides burner elements installed as the peripheral walls of the cylindrical or prismatic space formed at or near the center of the case, for heating on both sides of the case. The top and bottom of the case are coated with a sealant on the surfaces facing the inside of the case. In addition, the top and bottom may also be wholly or partially covered with at least one metallic sheet on the surfaces facing the inside of the case. When only partially covered with a metallic sheet, the remaining portion of the inside surface of the case is coated with a sealant to keep portions of the case other than the burner elements gas-tight.

A packing may be placed between the burner element and the metallic sheet, and/or between the burner element and the ceramic fibers, and/or between the case and the ceramic fibers.

The fifth embodiment of the present invention provides a leak preventive structure for a case of a surface combustion burner where the case is cylindrical or prismatically shaped, similar to the fourth embodiment described above. However, the fifth embodiment provides that the top, bottom and burner element form a premixture chamber. In addition, the top and bottom are coated with a sealant on the surfaces facing the premixture chamber in order to prevent leakage of the premixture from the surfaces of the top and bottom of the case. A metallic sheet having a thermal expansion prevention means may partially or wholly cover the top and bottom of the case, and the portions of the top and bottom not covered by a metallic sheet are coated or impregnated by a sealant.

A typical perspective illustration showing an embodiment where the leak preventive structure for a case of a surface combustion burner of the present invention is applied to a flatly installed surface combustion burner.

FIG. 2

Figure 1:
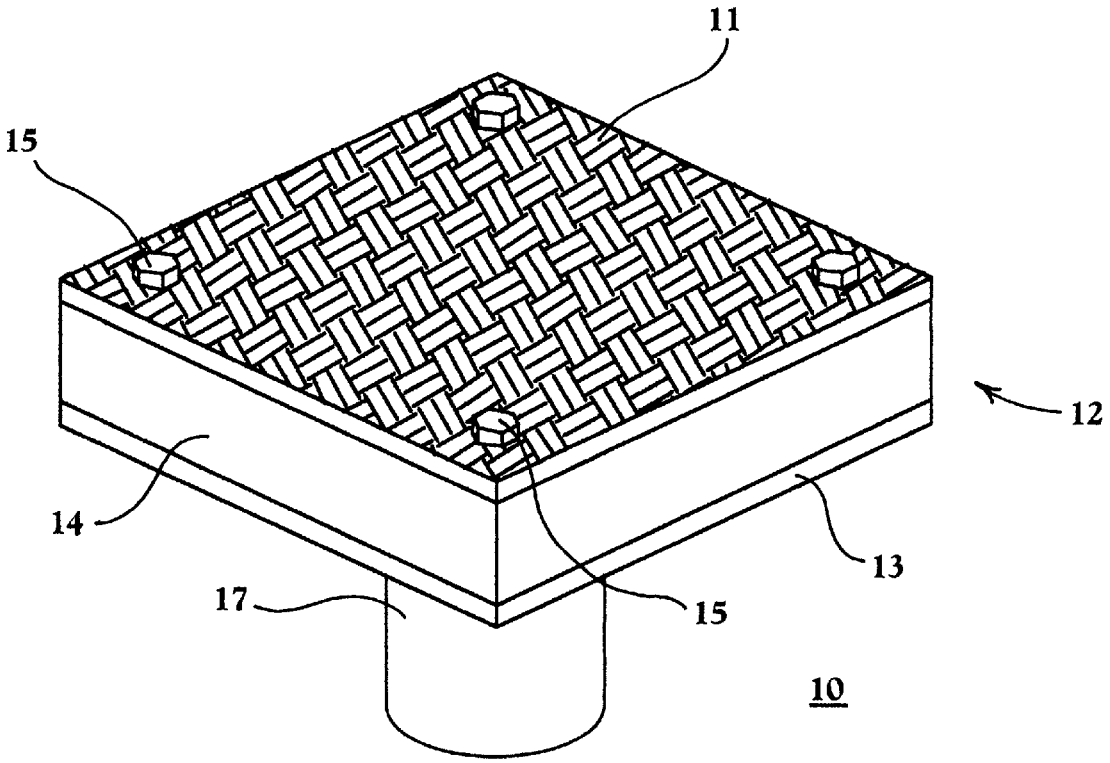
FIG. 1

A typical exploded perspective illustration of the flatly installed surface combustion burner shown in FIG. 1.

FIG. 3

A typical sectional illustration showing an important portion of another embodiment of the leak preventive structure for a case of a surface combustion burner of the present invention.

FIG. 4

A typical sectional illustration showing an important portion of a further other embodiment of the leak preventive structure for a case of a surface combustion burner of the present invention.

FIG. 5

A typical sectional illustration showing an important portion of a still further other embodiment of the leak preventive structure for a case of a surface combustion burner of the present invention.

FIG. 6

A typical sectional illustration showing an important portion of a still further other embodiment of the leak preventive structure for a case of a surface combustion burner of the present invention.

FIG. 7

A typical sectional illustration showing an important portion of a still further other embodiment of the leak preventive structure for a case of a surface combustion burner of the present invention.

FIG. 8

A typical perspective illustration showing a still further other embodiment of the leak preventive structure for a case of a surface combustion burner of the present invention.

FIG. 9

Figure 8:
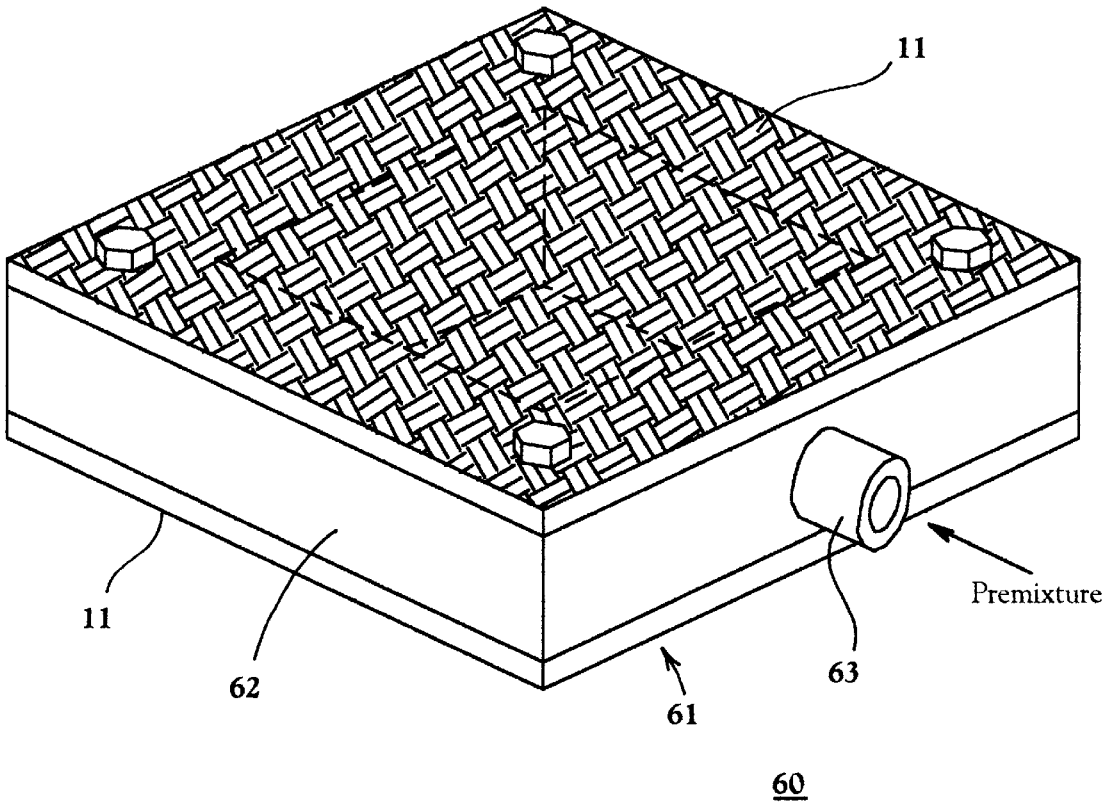

A typical sectional illustration of the flatly installed surface combustion burner shown in FIG. 8.

FIG. 10

A typical perspective illustration showing an important portion of an embodiment where the leak preventive structure for a case of a surface combustion burner of the present invention is applied to a circularly installed surface combustion burner.

FIG. 11

Figure 10:
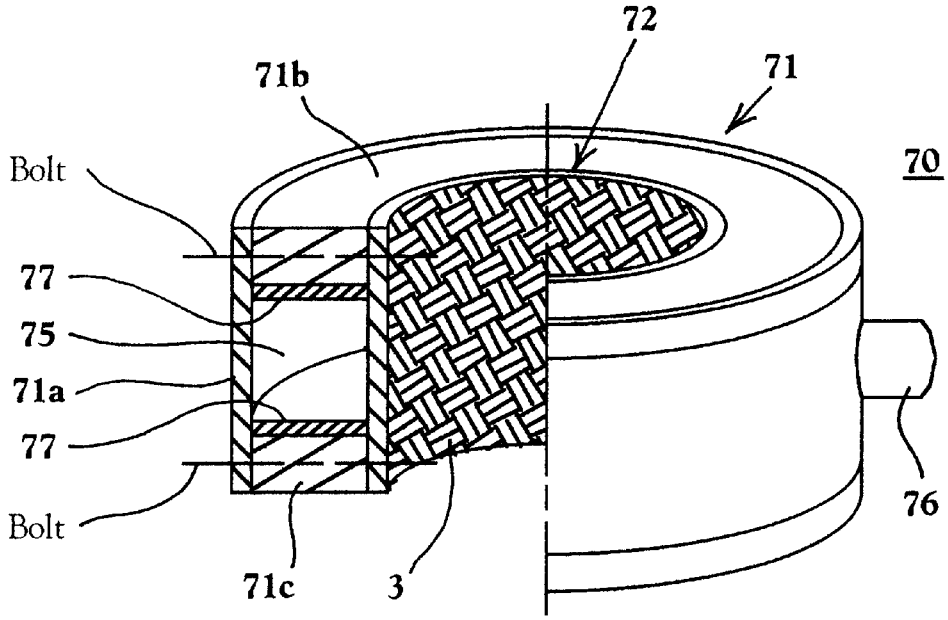

A typical sectional illustration showing an important portion of the case for the circularly installed surface combustion burner shown in FIG. 10.

FIG. 12

A typical sectional illustration showing an important portion of another embodiment where the leak preventive structure for a case of a surface combustion burner of the present invention is applied to a circularly installed surface combustion burner.

FIG. 13

A typical sectional illustration showing an important portion of a further other embodiment where the leak preventive structure for a case of a surface combustion burner of the present invention is applied to a circularly installed surface combustion burner.

FIG. 14

A typical sectional illustration showing an important portion of a still further other embodiment where the leak preventive structure for a case of a surface combustion burner of the present invention is applied to a circularly installed surface combustion burner.

FIG. 15

A typical sectional illustration showing an important portion of a still further other embodiment where the leak preventive structure for a case of a surface combustion burner of the present invention is applied to a circularly installed surface combustion burner.

FIG. 16

A typical sectional perspective illustration showing an important portion of a still further other embodiment where the leak preventive structure for a case of a surface combustion burner of the present invention is applied to a circularly installed surface combustion burner.

FIG. 17

A typical sectional perspective illustration showing an important portion of a still further other embodiment where the leak preventive structure for a case of a surface combustion burner of the present invention is applied to a circularly installed surface combustion burner.

FIG. 18

A typical perspective illustration showing a still further other embodiment where the leak preventive structure for a case of a surface combustion burner of the present invention is applied to a circularly installed surface combustion burner.

FIG. 19

Figure 18:
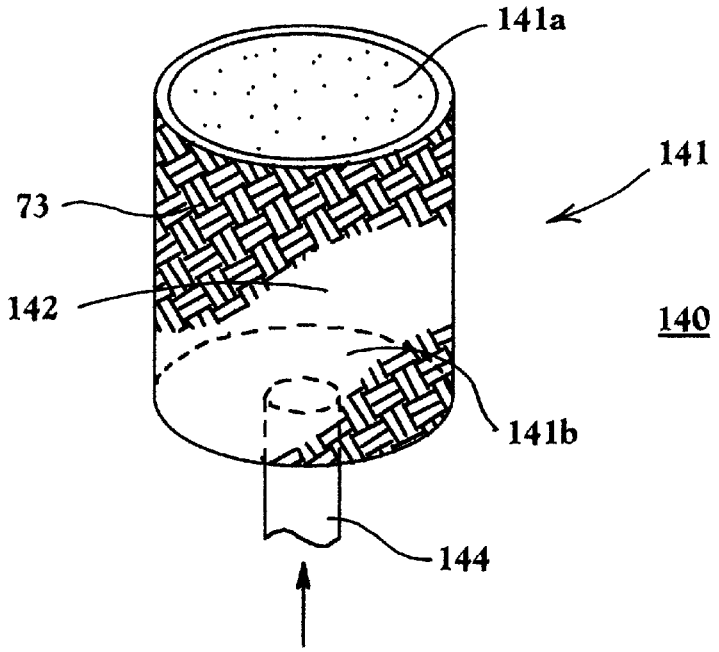

A typical sectional illustration showing an important portion of the circularly installed surface combustion burner shown in FIG. 18.

FIG. 20

A typical sectional illustration showing a presently used flatly installed surface combustion burner as an example.

FIG. 21

A typical sectional perspective illustration showing an important portion of a presently used circularly installed surface combustion burner as an example.

PRIOR ARTS

For premix surface combustion burners using a fiber mat obtained by forming a heat resistant metallic or ceramic or other fibers as a mat or a porous mat such as a ceramic mat as the surface combustion burner element, proposed are leak preventive structures with a means for preventing the leak of the premixture from any other portions than the burner combustion places.

Typical leak preventive structures for surface combustion burners include a structure with a surface combustion burner element 1 immobilized to a stainless steel or other metallic case 2 by bolts 3, etc. (see FIG. 18), a structure with a surface combustion burner element 1 held by a flange of a metallic case 2, a structure with a weldable surface combustion burner element 1 welded at the entire circumference to a metallic case, and a case with a sintered ceramic compact or ceramic fibers used at its high temperature portions.

Figure 19:
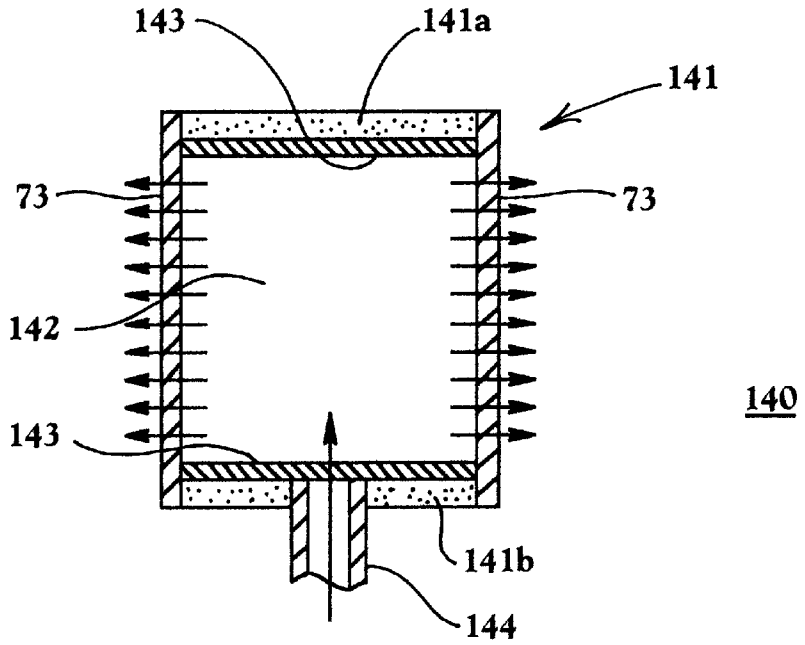
Figure 20:
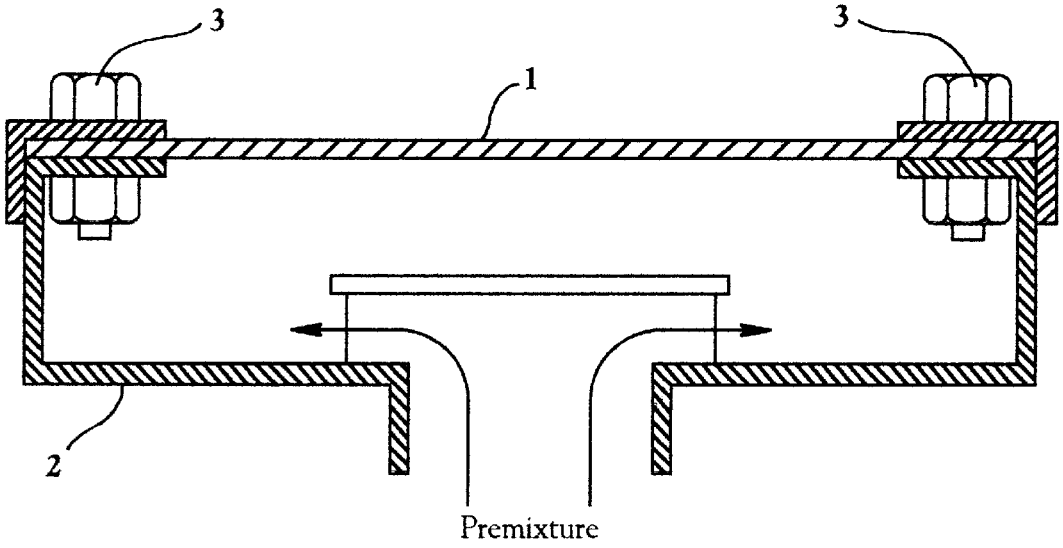
Figure 21:
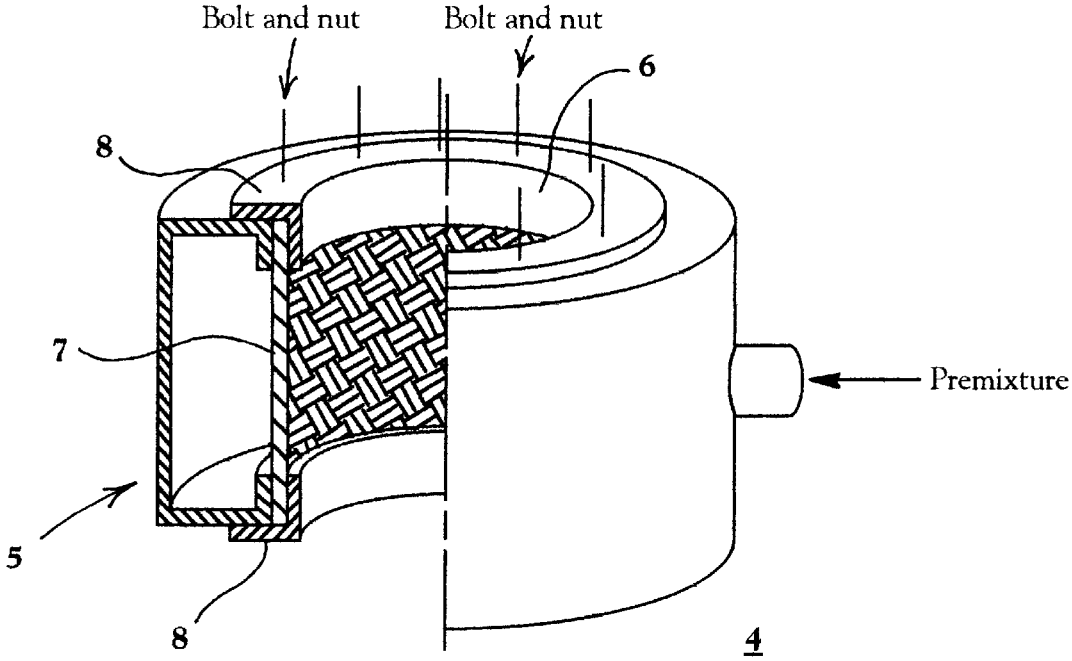

Furthermore, there is a surface combustion burner 4 as shown in FIG. 19. In the surface combustion burner 4, a cylindrical metallic case 5 of stainless steel, etc. has a cylindrical space 6 at the center of the metallic case 5, and the peripheral wall of the space 6 in the metallic case 5 is opened. Along the open face, a burner element 7 is installed and immobilized using metallic keep plates 8 installed along the top and bottom edges along the cylindrical space 6 of the case 5 by bolts, etc. (not illustrated).

As another version, a ceramic material is used at the top and bottom of the metallic case 5, and the burner element 7 is installed along the peripheral wall of the space 6 and immobilized by bolts, etc. (not illustrated) to the top and bottom.

[Problems to be solved by the invention]

However, if the surface combustion burner element 1 is immobilized to the metallic case 2 by the bolts 3 as shown in FIG. 18, or held by the flange of the metallic case, it can happen that the metallic case 2 is thermally expanded by the heat transfer from the combustion face or the radiation heat from the flame, etc. to cause the leak of premixture or backfire. Similarly also in the surface combustion burner 4 shown in FIG. 19, it can happen that the metallic case 5 is thermally deformed by the heat transfer from the combustion face, the radiation heat from the flame, etc., to cause the leak of premixture or backfire.

Also when the surface combustion burner element 1 is welded at the entire circumference to the metallic case, the weld zone may be broken by thermal deformation.

Moreover, if a sintered ceramic compact is used at the high temperature portions of the case, the burner is disadvantageously weak against mechanical impact and costly.

If ceramic fibers, etc. are used, the premixture leaks since the fibers have some porosity not allowing perfect sealing.

The present invention is proposed to improve these problems. The object of the present invention is to provide a leak preventive structure for a case of a surface combustion burner using a fiber mat obtained by forming metallic or ceramic fibers as a mat or a ceramic porous mat, etc. as a burner element, which prevents the leak of fuel and combustion air from any other portions than the combustion face of the burner element.

[Means for solving the problems]

To solve the above problems, the present invention provides a leak preventive structure for a case of a flatly installed surface combustion burner, in which a fiber mat as a burner element is installed flatly in a case, characterized in that said case has an open face and uses ceramic fibers to form its lateral walls, that said open face is closed by the burner element immobilized there, and that the lateral walls are coated with a sealant on the surfaces facing the inside of the case.

The present invention also provides a leak preventive structure for a case of a flatly installed surface combustion burner, in which a fire resistant porous mat as a burner element is installed flatly in a case, characterized in that the said case has an open face and uses ceramic fibers to form its lateral walls, that said open face is closed by the burner element immobilized there, and that the lateral walls are coated with a sealant on the surfaces facing the inside of the case.

The present invention also provides a leak preventive structure for a case of a flatly installed surface combustion burner, in which a fiber mat as a burner element is installed flatly in a case, characterized in that said case has an open face and uses ceramic fibers to form its lateral walls, that said open face is closed by the burner element immobilized there, and that the lateral walls are impregnated with a sealant beforehand on the surfaces facing the inside of the case.

The present invention also provides a leak preventive structure for a case of a flatly installed surface combustion burner, in which a fire resistant porous mat as a burner element is installed flatly in a case, characterized in that said case has an open face and uses ceramic fibers to form its lateral walls, that said open face is closed by the burner element immobilized there, and that the lateral walls are impregnated with a sealant beforehand on the surfaces facing the inside of the case.

The present invention also provides a leak preventive structure for a case of a flatly installed surface combustion burner, in which a fiber mat as a burner element is installed flatly in a case, characterized in that said case has an open face and uses ceramic fibers to form its lateral walls, that said open face is closed by the burner element immobilized there, and that the ceramic fibers are covered with at least one metallic sheet on the surfaces facing the inside of the case.

The present invention also provides a leak preventive structure for a case of a flatly installed surface combustion burner, in which a fire resistant porous mat as a burner element is installed flatly in a case, characterized in that said case has an open face and uses ceramic fibers to form its lateral walls, that said open face is closed by the burner element immobilized there, and that the ceramic fibers are covered with at least one metallic sheet on the surfaces facing the inside of the case.

The present invention also provides a leak preventive structure for a case of a flatly installed surface combustion burner, in which a fiber mat as a burner element is installed flatly in a case, characterized in that said case has an open face and uses ceramic fibers to form its lateral walls, that said open face is closed by the burner element immobilized there, and that the ceramic fibers are covered with at least one metallic sheet partially on the surfaces facing the inside of the case, and coated with a sealant at least on the other portions of the surfaces.

The present invention also provides a leak preventive structure for a case of a flatly installed surface combustion burner, in which a fire resistant porous mat as a burner element is installed flatly in a case, characterized in that said case has an open face and uses ceramic fibers to form its lateral walls, that said open face is closed by the burner element immobilized there, and that the ceramic fibers are covered with at least one metallic sheet partially on the surfaces facing the inside of the case, and coated with a sealant at least on the other portions of the surfaces.

In the above structure, the metallic sheet can be provided with a means for preventing thermal expansion.

The present invention also provides a leak preventive structure for a case of a flatly installed surface combustion burner, in which a fiber mat as a burner element is installed flatly in a case, characterized in that said case has an open face for installing the burner element, and has its walls covered with at least one metallic sheet on the surfaces facing the inside of the case, and that the regions surrounding the portions where the burner element is attached are covered with ceramic fibers.

The present invention also provides a leak preventive structure for a case of a flatly installed surface combustion burner, in which a fire resistant porous mat as a burner element is installed flatly in a case, characterized in that said case has an open face for installing the burner element, and has its walls covered with at least one metallic sheet on the surfaces facing the inside of the case, and that the regions surrounding the portions where the burner element is attached are covered with ceramic fibers.

The present invention also provides a leak preventive structure for a case of a flatly installed surface combustion burner, in which fiber mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are coated with a sealant on the inside surfaces.

The present invention also provides a leak preventive structure for a case of a flatly installed surface combustion burner, in which fire resistant porous mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are coated with a sealant on the inside surfaces.

The present invention also provides a leak preventive structure for a case of a flatly installed surface combustion burner, in which fiber mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are impregnated with a sealant beforehand on the inside surfaces.

The present invention also provides a leak preventive structure for a case of a flatly installed surface combustion burner, in which fire resistant porous mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are impregnated with a sealant beforehand on the inside surfaces.

The present invention also provides a leak preventive structure for a case of a flatly installed surface combustion burner, in which fiber mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are covered with at least one metallic sheet on the inside surfaces.

The present invention also provides a leak preventive structure for a case of a flatly installed surface combustion burner, in which fire resistant porous mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are covered with at least one metallic sheet on the inside surfaces.

The present invention also provides a leak preventive structure for a case of a flatly installed surface combustion burner, in which fiber mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are covered with at least one metallic sheet partially on the inside surfaces and coated with a sealant at least on the other portions of the surfaces.

The present invention also provides a leak preventive structure for a case of a flatly installed surface combustion burner, in which fire resistant porous mats as burner elements are installed flatly in a case, characterized in that a pair of opposite sides of the case are provided as open faces, that the burner elements are installed in the open faces, that ceramic fibers are used to form the other walls than the burner element installed faces of the case, and that said other walls are covered with at least one metallic sheet partially on the inside surfaces and coated with a sealant at least on the other portions of the surfaces.

In the above structure, the metallic sheet in the case can be provided with a means for preventing thermal expansion.

Furthermore, in the above structure, a packing can be provided between the burner element and the metallic sheet, and/or between the burner element and the ceramic fibers, and/or between the case and the ceramic fibers.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat as a burner element is immobilized along the peripheral wall of the space, characterized in that the top and bottom of the case are coated with a sealant on the surfaces facing the inside of the case, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat as a burner element is immobilized along the peripheral wall of the space, characterized in that the top and bottom of the case are coated with a sealant on the surfaces facing the inside of the case, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat as a burner element is immobilized along the peripheral wall of the space, characterized in that the top and bottom of the case are impregnated with a sealant beforehand on the surfaces facing the inside of the case, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat as a burner element is immobilized along the peripheral wall of the space, characterized in that the top and bottom of the case are impregnated with a sealant beforehand on the surfaces facing the inside of the case, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat as a burner element is immobilized along the peripheral wall of the space, characterized in that the top and bottom of the case are covered with at least one metallic sheet on the surfaces facing the inside of the case, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat as a burner element is immobilized along the peripheral wall of the space, characterized in that the top and bottom of the case are covered with at least one metallic sheet on the surfaces facing the inside of the case, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat as a burner element is immobilized along the peripheral wall of the space, characterized in that the top and bottom of the case are covered with at least one metallic sheet partially on the surfaces facing the inside of the case and coated with a sealant at least on the other portions of the surfaces, for keeping the case gas-tight at the other portions than said burner element.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat as a burner element is immobilized along the peripheral wall of the space, characterized in that the top and bottom of the case are covered with at least one metallic sheet partially on the surfaces facing the inside of the case, and coated with a sealant at least on the other portions of the surfaces, for keeping the case gas-tight at the other portions than said burner element.

In the above structure, the metallic sheet can be provided with a means for preventing thermal expansion.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat as a burner element is immobilized along the peripheral wall of the space, characterized in that the peripheral wall of the case is formed by at least one metallic sheet, and that the top and bottom are covered with said metallic sheet on the surfaces facing the inside of the case and also on the surfaces facing the cylindrical or prismatic space formed at or near the center of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat as a burner element is immobilized along the peripheral wall of the space, characterized in that the peripheral wall of the case is formed by at least one metallic sheet, and that the top and bottom are covered with said metallic sheet on the surfaces facing the inside of the case and also on the surfaces facing the cylindrical or prismatic space formed at or near the center of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat as a burner element is immobilized along the peripheral wall of the space, characterized in that the peripheral wall of the case is formed by at least one metallic sheet, that the metallic sheet is extended to the top and bottom of the case and also to the burner element attaching portions, that the burner element and the extended metallic sheet are fastened at the burner element attaching portions by clamping means from the cylindrical or prismatic space side, and that the clamping means are covered, at their outside ends, with the top and bottom of the case formed by ceramic fibers, with a space kept between the clamping means and the top or bottom respectively.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat as a burner element is immobilized along the peripheral wall of the space, characterized in that the peripheral wall of the case is formed by at least one metallic sheet, that the metallic sheet is extended to the top and bottom of the case and also to the burner element attaching portions, that the burner element and the extended metallic sheet are fastened at the burner element attaching portions by clamping means from the cylindrical or prismatic space side, and that the clamping means are covered, at their outside ends, with the top and bottom of the case formed by ceramic fibers, with a space kept between the clamping means and the top or bottom respectively.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the burner element is installed as the peripheral wall of the case, and that the top and bottom, and also the peripheral wall of the cylindrical or prismatic space are coated with a sealant on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the peripheral wall of the cylindrical or prismatic space at or near the center of the case is formed by at least one metallic sheet, that the burner element is installed as the peripheral wall of the case, and that the top and bottom are coated with a sealant on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the burner element is installed as the peripheral wall of the case, and that the top and bottom, and also the peripheral wall of the cylindrical or prismatic space are coated with a sealant on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the peripheral wall of the cylindrical or prismatic space at or near the center of the case is formed by at least one metallic sheet, that the burner element is installed as the peripheral wall of the case, and that the top and bottom are coated with a sealant on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the burner element is installed as the peripheral wall of the case, and that the top and bottom, and also the peripheral wall of the cylindrical or prismatic space are impregnated with a sealant beforehand on the ceramic fiber surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is as a burner element, characterized in that the peripheral wall of the cylindrical or prismatic space at or near the center of the case is formed by at least one metallic sheet, that the burner element is installed as the peripheral wall of the case, and that the ceramic fibers of the top and bottom are impregnated with a sealant beforehand on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the burner element is installed as the peripheral wall of the case, and that the top and bottom, and also the peripheral wall of the cylindrical or prismatic space are impregnated with a sealant beforehand on the ceramic fiber surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the peripheral wall of the cylindrical or prismatic space at or near the center of the case is formed by at least one metallic sheet, that the burner element is installed as the peripheral wall of the case, and that the ceramic fibers of the top and bottom are impregnated with a sealant beforehand on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the burner element is installed as the peripheral wall of the case, and that the top and bottom are covered with at least one metallic sheet on the surfaces facing the inside of the case, to keep the other portions than the burner element in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the burner element is installed as the peripheral wall of the case, and that the top and bottom are covered with at least one metallic sheet on the surfaces facing the inside of the case, to keep the other portions than the burner element in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the burner element is installed as the peripheral wall of the case, and that the top and bottom are covered with at least one metallic sheet partially on the surfaces facing the inside of the case and coated with a sealant at least on the other portions of the surfaces, to keep the other portions than the burner element in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the burner element is installed as the peripheral wall of the case, and that the top and bottom are covered with at least one metallic sheet partially on the surfaces facing the inside of the case and coated with a sealant at least on the other portions of the surfaces, to keep the other portions than the burner element in the case gas-tight.

In the above structure, the metallic sheet is provided with a means for preventing thermal expansion.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the peripheral wall of the cylindrical or prismatic space in the case is formed by at least one metallic sheet, that the burner element is installed as the peripheral wall of the case, and that the top and bottom are coated with at least one metal sheet on the surfaces facing the inside of the case, on the surfaces facing the cylindrical or prismatic space formed at or near the center of the case and also on the outside peripheral surfaces of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the peripheral wall of the cylindrical or prismatic space in the case is formed by at least one metallic sheet, that the burner element is installed as the peripheral wall of the case, and that the top and bottom are coated with at least one metal sheet on the surfaces facing the inside of the case, on the surfaces facing the cylindrical or prismatic space formed at or near the center of the case and also on the outside peripheral surfaces of the case.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the peripheral wall of the cylindrical or prismatic space in the case is formed by at least one metallic sheet, that the burner element is installed as the peripheral wall of the case, and that the top and bottom are coated with at least one metal sheet partially on the surfaces facing the inside of the case and coated with a sealant at least on the other surfaces, to keep the other portions than the burner element in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the peripheral wall of the cylindrical or prismatic space in the case is formed by at least one metallic sheet, that the burner element is installed as the peripheral wall of the case, and that the top and bottom are coated with at least one metal sheet partially on the surfaces facing the inside of the case and coated with a sealant at least on the other surfaces, to keep the other portions than the burner element in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and a fiber mat is used as a burner element, characterized in that the peripheral wall of the cylindrical or prismatic space in the case is formed by at least one metallic sheet, that the burner element is installed as the peripheral wall of the case, that the metallic sheet is extended to the top and bottom of the case and also to the burner element attaching portions, that the burner element and the extended metallic sheet are fastened at the burner element attaching portions by clamping means, and that the a space is formed between the clamping means and the ceramic fibers of the top and bottom respectively.

The present invention also provides a leak preventive structure for a case of a circularly installed cylindrical surface combustion burner, in which ceramic fibers are used to form the top and bottom of a case with at least one vertical cylindrical or prismatic space in the case, and a fire resistant porous mat is used as a burner element, characterized in that the peripheral wall of the cylindrical or prismatic space in the case is formed by at least one metallic sheet, that the burner element is installed as the peripheral wall of the case, that the metallic sheet is extended to the top and bottom of the case and also to the burner element attaching portions, that the burner element and the extended metallic sheet are fastened at the burner element attaching portions by clamping means, and that a space is formed between the clamping means and the ceramic fibers of the top or bottom respectively.

In the above structure, the metallic sheet is provided with a means for preventing thermal expansion.

The present invention also provides a leak preventive structure for a case of a circularly installed cylindrical surface combustion burner, in which ceramic fibers are used to form the top and bottom of a case with at least one vertical cylindrical or prismatic space in the case, and fiber mats are used as burner elements, characterized in that the burner elements are installed as the peripheral wall of the case and the peripheral wall of the cylindrical or prismatic space formed at or near the center of the case, for heating on both sides, and that the top and bottom are coated with a sealant on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and fire resistant porous mats are used as burner elements, characterized in that the burner elements are installed as the peripheral wall of the case and the peripheral wall of the cylindrical or prismatic space formed at or near the center of the case, for heating on both sides, and that the top and bottom are coated with a sealant on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and fiber mats are used as burner elements, characterized in that the burner elements are installed as the peripheral wall of the case and the peripheral wall of the cylindrical or prismatic space formed at or near the center of the case, for heating on both sides, and that the ceramic fibers of the top and bottom are impregnated with a sealant beforehand on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and fire resistant porous mats are used as burner elements, characterized in that the burner elements are installed as the peripheral wall of the case and the peripheral wall of the cylindrical or prismatic space formed at or near the center of the case, for heating on both sides, and that the ceramic fibers of the top and bottom are impregnated with a sealant beforehand on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and fiber mats are used as burner elements, characterized in that the burner elements are installed as the peripheral wall of the case and the peripheral wall of the cylindrical or prismatic space formed at or near the center of the case, for heating on both sides, and that the top and bottom are covered with at least one metallic sheet on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and fire resistant porous mats are used as burner elements, characterized in that the burner elements are installed as the peripheral wall of the case and the peripheral wall of the cylindrical or prismatic space formed at or near the center of the case, for heating on both sides, and that the top and bottom are covered with at least one metallic sheet on the surfaces facing the inside of the case.

The present invention also provides a leak preventive structure for a case of a circularly installed cylindrical surface combustion burner, in which ceramic fibers are used to form the top and bottom of a case with at least one vertical cylindrical or prismatic space in the case, and fiber mats are used as burner elements, characterized in that the burner elements are installed as the peripheral wall of the case and the peripheral wall of the cylindrical or prismatic space formed at or near the center of the case, for heating on both sides, and that the top and bottom are covered with at least one metallic sheet partially on the surfaces facing the inside of the case and coated with a sealant at least on the other surfaces, to keep the other portions than the burner elements in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and fire resistant porous mats are used as burner elements, characterized in that the burner elements are installed as the peripheral wall of the case and the peripheral wall of the cylindrical or prismatic space formed at or near the center of the case, for heating on both sides, and that the top and bottom are covered with at least one metallic sheet partially on the surfaces facing the inside of the case and coated with a sealant at least on the other surfaces, to keep the other portions than the burner elements in the case gas-tight.

The present invention also provides a leak preventive structure for a case of a circularly installed cylindrical surface combustion burner, in which ceramic fibers are used to form the top and bottom of a case with at least one vertical cylindrical or prismatic space in the case, and fiber mats are used as burner elements, characterized in that the burner elements are installed as the peripheral wall of the case and the peripheral wall of the cylindrical or prismatic space formed at or near the center of the case, for heating on both sides, that the metallic sheet is extended to the top and bottom of the case and also to the burner element attaching portions, that the burner elements and the extended metallic sheets on both sides are fastened at the burner element attaching portions by clamping means, and that a space is formed between the clamping means and the ceramic fibers of the top or bottom respectively on both sides.

The present invention also provides a leak preventive structure for a case of a circularly installed cylindrical surface combustion burner, in which ceramic fibers are used to form the top and bottom of a case with at least one vertical cylindrical or prismatic space in the case, and fire resistant porous mats are used as burner elements, characterized in that the burner elements are installed as the peripheral wall of the case and the peripheral wall of the cylindrical or prismatic space formed at or near the center of the case, for heating on both sides, that the metallic sheet is extended to the top and bottom of the case and also to the burner element attaching portions, that the burner elements and the extended metallic sheets on both sides are fastened at the burner element attaching portions by clamping means, and that a space is formed between the clamping means and the ceramic fibers of the top or bottom respectively on both sides.

In the above structure, the metallic sheet can be provided with a means for preventing thermal expansion.

In the above structure, a packing can be provided between the burner element and the metallic sheet, and/or between the burner element and the ceramic fibers, and/or between the case and the ceramic fibers.

The present invention also provides a leak preventive structure for a case of a surface combustion burner, characterized in that said case is cylindrical or prismatic and has its top and bottom formed by ceramic fibers, while a burner element formed by a fiber mat is installed along the peripheral wall of the case, that said top, bottom and burner element form a premixture chamber, and that the top and the bottom are coated with a sealant on the surfaces facing the premixture chamber, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fire resistant porous mat is installed along the peripheral wall of the case, that said top, bottom and burner element form a premixture chamber, and that the top and the bottom are coated with a sealant on the surfaces facing the chamber, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fiber mat is installed along the peripheral wall of the case, that said top, bottom and burner element form a premixture chamber, and that the top and the bottom are impregnated with a sealant beforehand on the surfaces facing the premixture chamber, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fire resistant porous mat is installed along the peripheral wall of the case, that said top, bottom and burner element form a premixture chamber, and that the top and the bottom are impregnated with a sealant beforehand on the surfaces facing the premixture chamber, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fiber mat is installed along the peripheral wall of the case, that said top, bottom and burner element form a premixture chamber, and that the top and the bottom are covered with at least one metallic sheet on the surfaces facing the premixture chamber, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fire resistant porous mat is installed along the peripheral wall of the case, that said top, bottom and burner element form a premixture chamber, and that the top and the bottom are covered with at least one metallic sheet on the surfaces facing the premixture chamber, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fiber mat is installed along the peripheral wall of the case, that said top, bottom and burner element form a premixture chamber, and that the top and the bottom are covered with at least one metallic sheet partially on the surfaces facing the premixture chamber and coated with a sealant at least on the other portions of the surfaces, to prevent the leak of the premixture from the surfaces of the top and the bottom other than the burner element.

The present invention also provides a leak preventive structure for a case of a surface combustion burner, characterized in that said case is cylindrical or prismatic and has its top and bottom formed by ceramic fibers, while a burner element formed by a fire resistant porous mat is installed along the peripheral wall of the case, that said top, bottom and burner element form a premixture chamber, and that the top and the bottom are covered with at least one metallic sheet partially on the surfaces facing the premixture chamber and coated with a sealant at least on the other portions of the surfaces, to prevent the leak of the premixture from the surfaces of the top and the bottom other than the burner element.

In the above structure, the metallic sheet is provided with a means for preventing thermal expansion.

The present invention also provides a leak preventive structure for a case of a surface combustion burner, characterized in that said case is cylindrical or prismatic and has its top and bottom formed by ceramic fibers, while a burner element formed by a fiber mat is installed along the peripheral wall of the case, that said top, bottom and burner element form a premixture chamber, that the top and the bottom are covered with at least one metallic sheet on the surfaces facing the premixture chamber, that the metallic sheet is extended to the peripheral wall at the portions where the burner element is attached, that the metallic sheet and the burner element are fastened by clamping means, and that a space is formed between the burner element attaching portions and the top or bottom of the case respectively.

The present invention also provides a leak preventive structure for a case of a surface combustion burner, characterized in that said case is cylindrical or prismatic and has its top and bottom formed by ceramic fibers, while a burner element formed by a fire resistant porous mat is installed along the peripheral wall of the case, that said top, bottom and burner element form a premixture chamber, that the top and the bottom are covered with at least one metallic sheet on the surfaces facing the premixture chamber, that the metallic sheet is extended to the peripheral wall at the portions where the burner element is attached, that the metallic sheet and the burner element are fastened by clamping means, and that a space is formed between the burner element attaching portions and the top or bottom of the case respectively.

In the above structure, a packing can be provided between the burner element and the metallic sheet, and/or between the burner element and the ceramic fibers, and/or between the case and the ceramic fibers.

Several embodiments of the leak preventive structure for a case of a surface combustion burner of the present invention are described below based on drawings.

FIG. 1 shows a flatly installed surface combustion burner 10.

The surface combustion burner 10 uses a fiber mat obtained by forming metallic or ceramic fibers as a mat or a ceramic porous mat, etc. as a burner element 11. In the surface combustion burner 10, the burner element 11 is immobilized by bolts and nuts 15 at four comers on the top open side of a square case 12, together with a metallic bottom plate 13 and lateral walls 14 formed by ceramic fibers to constitute the case 12. The bolts and nuts 15 are usually made of a metal, but since the portions where they are used are exposed to high temperature, ceramic bolts and nuts can also be used.

Figure 2:
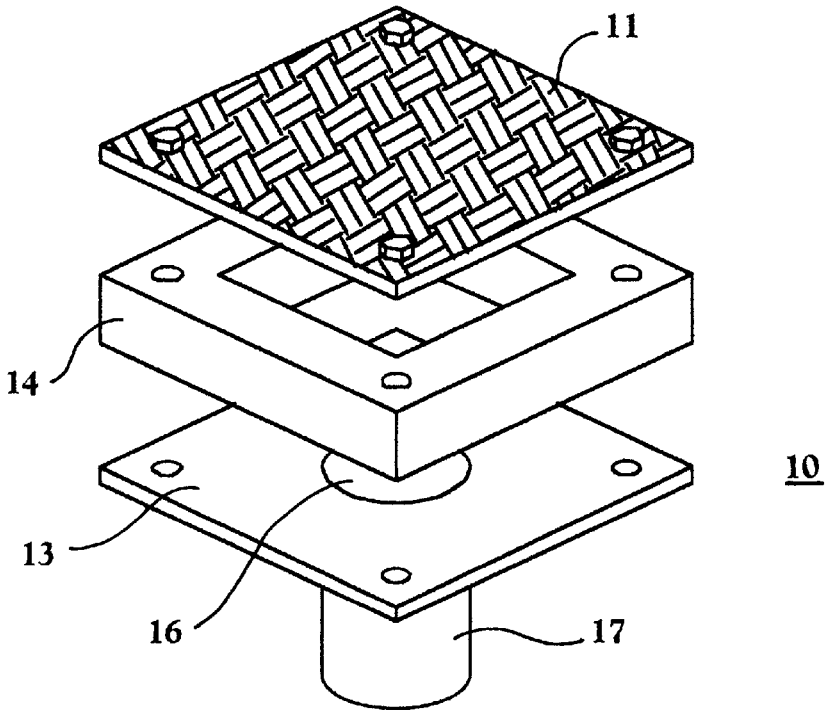

At the center of the bottom plate 13, a premixture supply port 16 is formed (see FIG. 2), so that a premixture can be supplied from a premixture supply pipe 17 into the case 12 through the supply port 16.

The ceramic fibers are produced by adding a binder to ceramic fibers with a diameter of about several microns made of alumina, silica or zirconia, etc. to allow forming into desired forms, and has fire resistance, heat insulation and resiliency.

Figure 3:
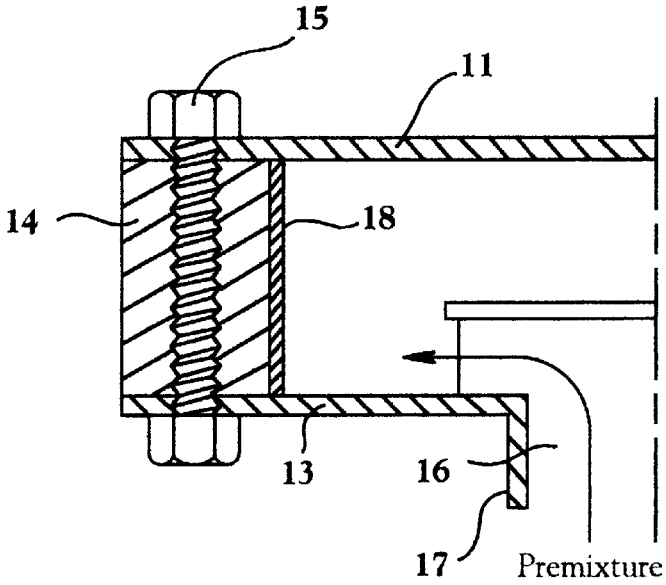

The lateral walls 14 formed by ceramic fibers in the case 12 are coated with a sealant 18 such as a coating cement on the inside surfaces (see FIG. 3). The sealant 18 is a cement produced by kneading ceramic fibers with a liquid material or inorganic binder solution of an inorganic or organic adhesive, silicone, synthetic rubber or grease, etc.

The ceramic fibers used to form the lateral walls 14 can also be impregnated with the sealant 18 beforehand.

In the surface combustion burner 10 as described above, since the lateral walls 14 of the case 12 are formed by heat resistant and highly heat insulating ceramic fibers, they are less thermally expanded.

The inside surfaces of the surface combustion burner element 11 (inside the case 12) are exposed to relatively low temperature and less likely to be affected by the flame. So, the inside surfaces of the lateral walls 14 can be coated with a sealant 18 such as a coating cement or the lateral walls 14 formed by ceramic fibers can be impregnated with the sealant 18 beforehand, to keep the ceramic fibers gas-tight and to prevent the leak of fuel and premixture from the lateral walls 14.

Figure 4:
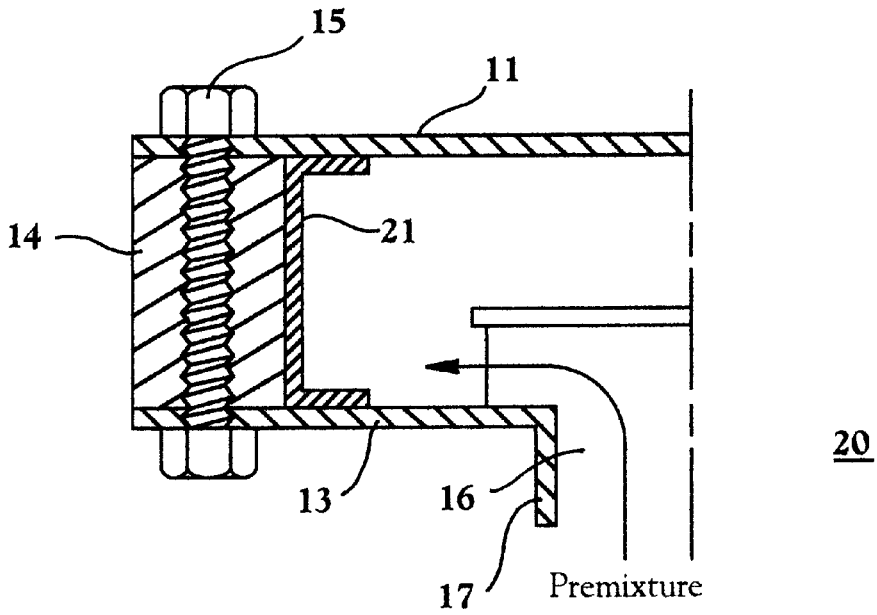

The leak preventive structure for a case of a surface combustion burner of the present invention can also be embodied as described below. In the flatly installed surface combustion burner 20 shown in FIG. 4, the lateral walls 14 formed by ceramic fibers are covered with a metallic sheet 21 on the inside surfaces, to be gas-tight. The metallic sheet 21 covers the inside surfaces of the lateral walls entirely. The inside surfaces of the lateral walls 14 may also be partially coated with a sealant.

In this structure, since the ceramic fibers are covered with a metallic sheet, without being exposed inside the case 12, they are kept gas-tight, and the leak of fuel and premixture from the lateral walls 14 can be prevented.

Figure 5:
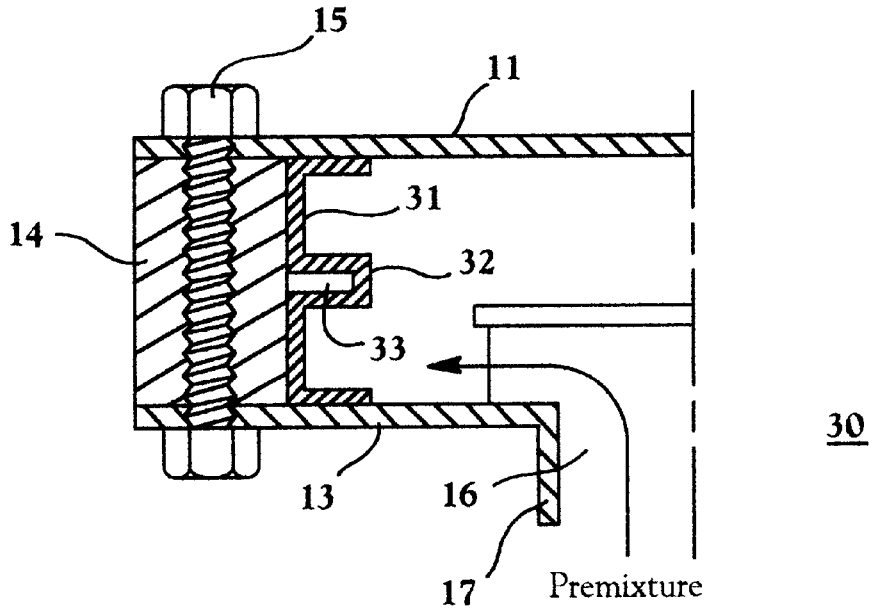

The leak preventive structure for a case of a surface combustion burner of the present invention can also be embodied as shown in FIG. 5. In the flatly installed surface combustion burner 30 shown in FIG. 5, the lateral walls 14 formed by ceramic fibers are covered, on the inside surfaces, with a metallic sheet 31 provided with a means for preventing thermal expansion, to be gas-tight. The metallic sheet 31 is provided with a thermal expansion absorbing means 32 which is protruded inwardly in the case 12 from the inside surface of the lateral wall 14 covered with the metallic sheet 31 at the center of the metallic sheet 31. The thermal expansion absorbing means 32 contains an absorbing space 33 on the lateral wall 14 side. A plurality of the thermal expansion absorbing means 32 can also be provided for each of the lateral walls 14, or the thermal expansion absorbing means can also be formed along the periphery of each of the lateral walls 14. Furthermore, the thermal expansion absorbing means 32 can also be formed in stripes vertically on the lateral walls 14, or can also be formed in any other proper manner.

Figure 6:
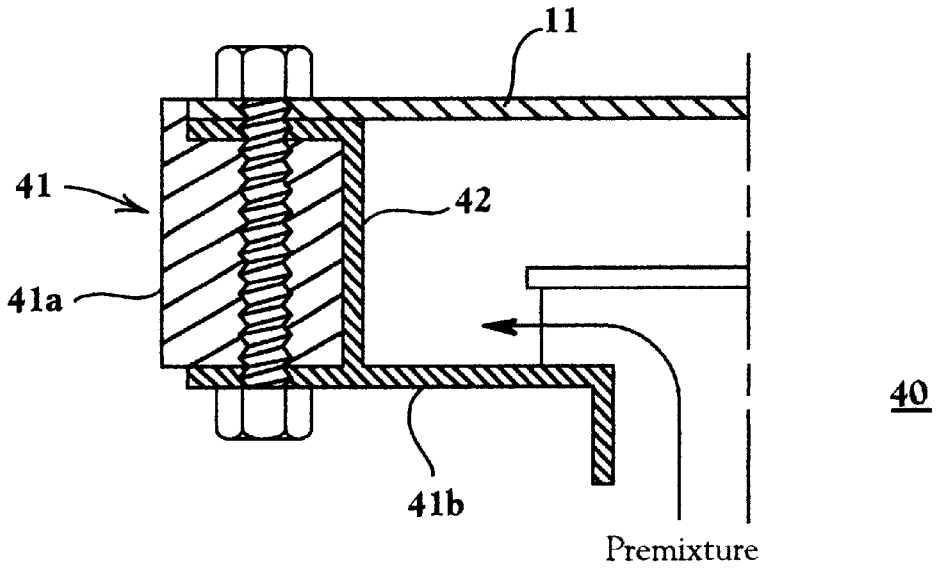

The leak preventive structure for a case of a surface combustion burner of the present invention can also be embodied as shown in FIG. 6. In the flatly installed surface combustion burner 40 shown in FIG. 6, in the case 41, the inside surfaces of the lateral walls 41*a* formed by ceramic fibers and the bottom plate 41*b* are integrally formed by a metallic sheet 42. In the case 41, the metallic sheet 42 is extended to the tops of the lateral walls 41*a*, and the burner element 11 is immobilized by bolts and nuts 15 installed through the bottom plate 41*b* from the tops of the lateral walls 41*a*.

According to this structure, the lateral walls 41*a* can be kept air-tight by the metallic sheet 42 in the case 41, and the leak of premixture can be prevented.

Figure 7:
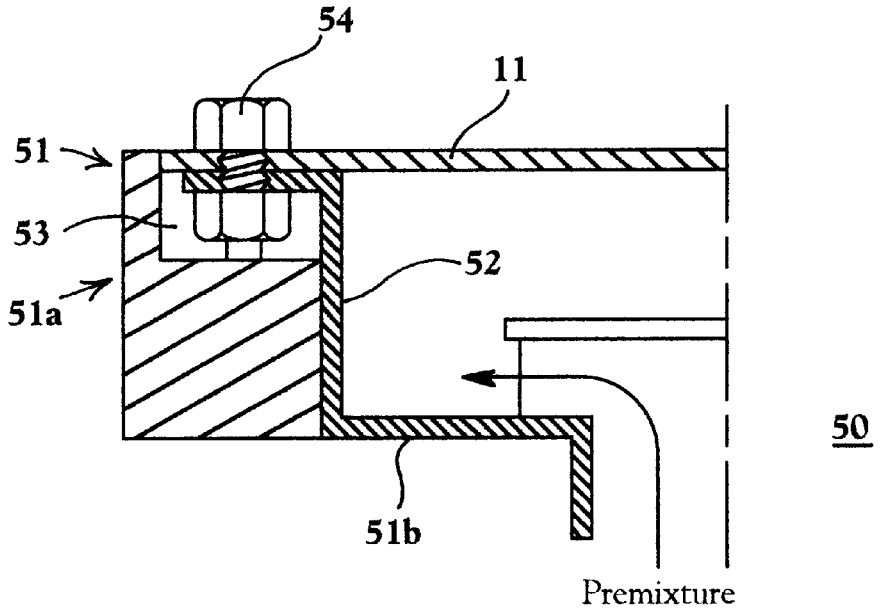

The leak preventive structure for a case of a surface combustion burner of the present invention can also be embodied as shown in FIG. 7. In the flatly installed surface combustion burner 50 shown in FIG. 7, in the case 51, the inside surfaces of the lateral walls 51*a* formed by ceramic fibers and the bottom plate 51*b* of the case 51 are formed by a metallic sheet 52, and the metallic sheet 52 is extended to the tops of the lateral walls 51*a*. The burner element 11 is immobilized by bolts 54 to the extended portion of the metallic sheet, and the portions where the burner element 11 is attached to the metallic sheet 52 are covered by the lateral walls 51*a* at its edges and on the under side, with a space 53 kept between the extended portion of the metallic sheet 52 and the corresponding lateral wall 51*a*.

According to this structure, gas-tightness can be secured, and the structure of the case 51 can be simplified. Furthermore, since the portions where the burner element 11 as a heating element is attached to the extended portion of the metallic sheet 52 is covered, on the under side, with the lateral walls 51*a* formed by ceramic fibers, with a space 53 kept between the extended portion of the metallic sheet 52 and the corresponding lateral wall 51*a*, the influence of thermal expansion can be minimized.

Figure 9:
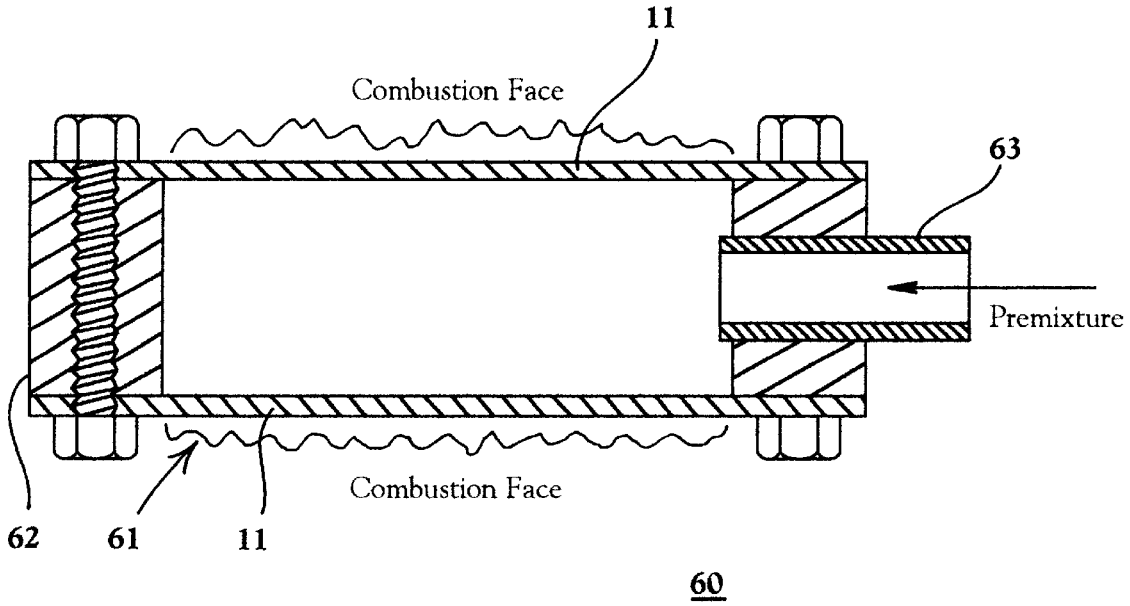

The leak preventive structure for a case of a surface combustion burner in the present invention can also be embodied as shown in FIGS. 8 and 9. In the flatly installed surface combustion burner 60 shown in FIGS. 8 and 9, unlike the flatly installed surface combustion burners 10, 20, 30, 40 and 50 described before, both the top and bottom of the case 61 are formed as open faces to have the burner element 11 installed, for forming combustion faces in both the open faces. In this flatly installed surface combustion burner 60, the premixture is introduced into the case 61 from a premixture supply pipe 63 installed in one of the lateral walls 62.

Also in the flatly installed surface combustion burner 60, the ceramic fibers can be coated with a sealant 18 such as a coating cement, or impregnated with the sealant 18 beforehand, or covered with a metallic sheet, respectively on the surfaces facing the inside of the case 61, to be gas-tight.

According to the flatly installed surface combustion burner 60 described above, the adverse effects of thermal expansion can be, prevented and gas-tightness can be secured. On the other hand, since the burner allows heating on both sides, it can be applied as a heat source for a wider range of various heaters.

Several embodiments of the leak preventive structure for a case of a surface combustion burner of the present invention have been described. In these embodiments, if a packing exists between the burner element forming the burner and the metallic sheet, and/or between the burner element and the ceramic fibers, and/or between the case and the ceramic fibers, or if clamping means such as washers are used for the bolts used to immobilize the burner element, the leak of premixture from the other portions than the burner element of the burner case can be reliably prevented.

The leak preventive structure for a case of a surface combustion burner of the present invention can also be applied to a circularly installed surface combustion burner. Embodiments of this version are described below.

FIG. 10 shows a circularly installed surface combustion burner 70 which is cylindrical in external form and has a case 71 annular in section and a cylindrical space 72 at the center of the case 71. The peripheral wall 71*a* of the case 71 is formed, for example, by a metallic sheet, and on the other hand, ceramic fibers are used to form the top 71*b* and the bottom 71*c* of the case 71.

Figure 11:
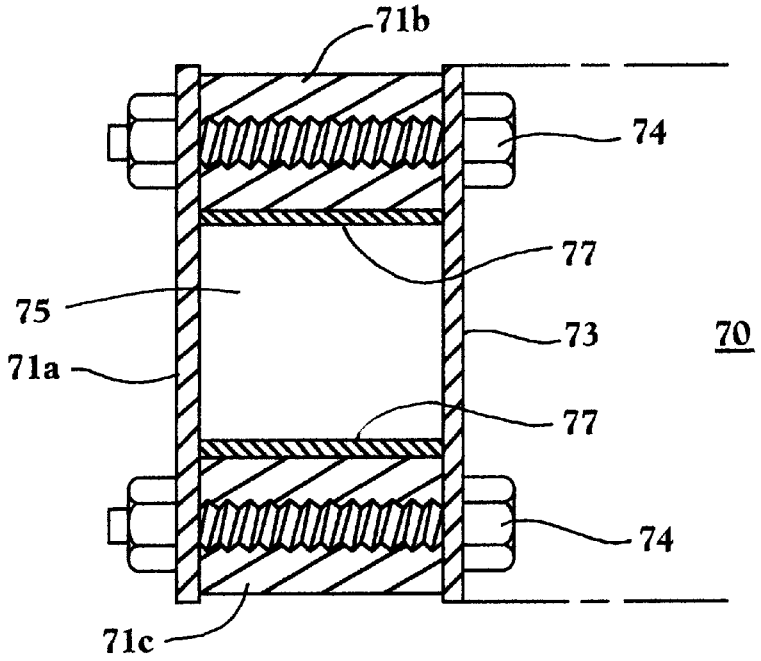

In the space 72, a burner element 73 such as a fiber mat is installed cylindrically along the peripheral wall of the space 72, and is immobilized by bolts 74, etc. to the top 71*b* and the bottom 71*c* (see FIG. 11).

Furthermore, in the case 71, a premixture introducing space 75 is formed to surround the cylindrical space 72 at the center of the case 71 by the peripheral wall 71*a*, the top 71*b*, the bottom 71*c* and the burner element 73. The peripheral wall 71*a* is also provided with a premixture supply pipe 76 for introducing the premixture into the premixture introducing space 75.

In the premixture introducing space 75 of the circularly installed surface combustion burner 70, the top 71*b* and the bottom 71*c* formed by ceramic fibers are coated on the inside surfaces with a sealant 77 such as a coating cement. The sealant 77 applied can prevent the leak of premixture from numerous fine pores existing in the inside surfaces of the ceramic fibers. The ceramic fibers can also be impregnated with the sealant 77 beforehand.

According to the circularly installed surface combustion burner 70 as described above, since the top 71*b* and the bottom 71*c* of the case 71 are formed by heat resistant and highly heat insulating ceramic fibers, the heat transfer to the peripheral wall 71*a* of the case 71 can be inhibited, to prevent the adverse effects of thermal expansion of the case 71.

Moreover, since the inside surface of the burner element 73 (in the premixture introducing space 75) is exposed to relatively low temperature and is less likely to be affected by the flame, the ceramic fibers used to form the top 71*b* and the bottom 71*c* can be coated on the inside surfaces with a sealant 77 such as a coating cement, or the top 71*b* and the bottom 71*c* formed by the ceramic fibers can be impregnated with the sealant 77 beforehand, to keep the top 71*b* and the bottom 71*c* gas-tight, for preventing the leak of fuel and premixture from any other portions than the burner element 73.

Figure 12:
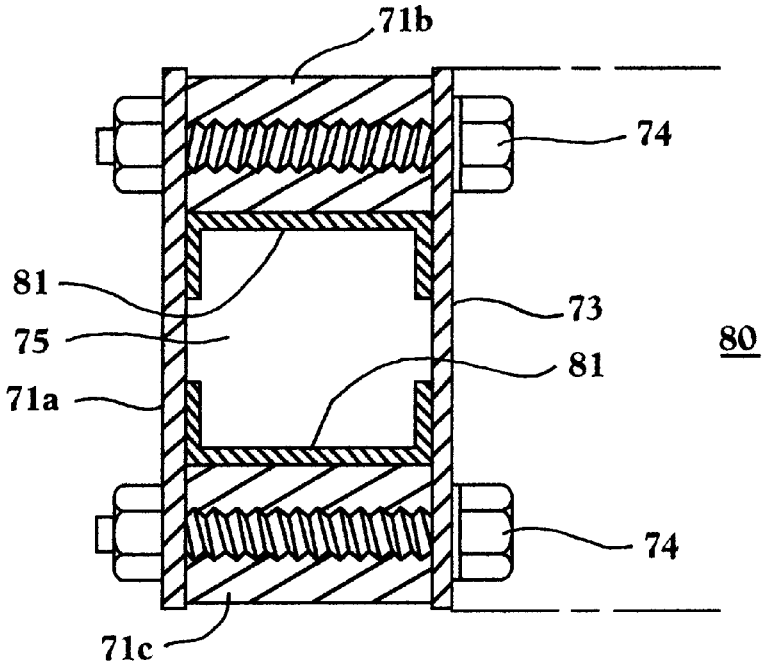

The leak preventive structure for a case of a surface combustion burner of the present invention can also be embodied as described below. In the circularly installed surface combustion burner 80 shown in FIG. 12, the top 71*b* and the bottom 71*c* are covered with a metallic sheet 81 on the premixture introducing space 85 side, to keep the top 71*b* and the bottom 71*c* gas-tight. The metallic sheet 81 covers the top 71*b* and the bottom 71*c* fully on the surfaces facing the premixture introducing space 75. The top 71*b* and the bottom 71*c* can also be partially covered with a metallic sheet on the premixture introducing space 75 side, while being coated with a sealant on the other portions.

Also according to this structure, since the ceramic fibers are covered with the metallic sheet 81, without being exposed to the premixture introducing space 75, the top 71*b* and the bottom 71*c* can be kept gas-tight, and the leak of fuel and premixture from any other portions than the burner element 73 can be prevented.

Figure 13:
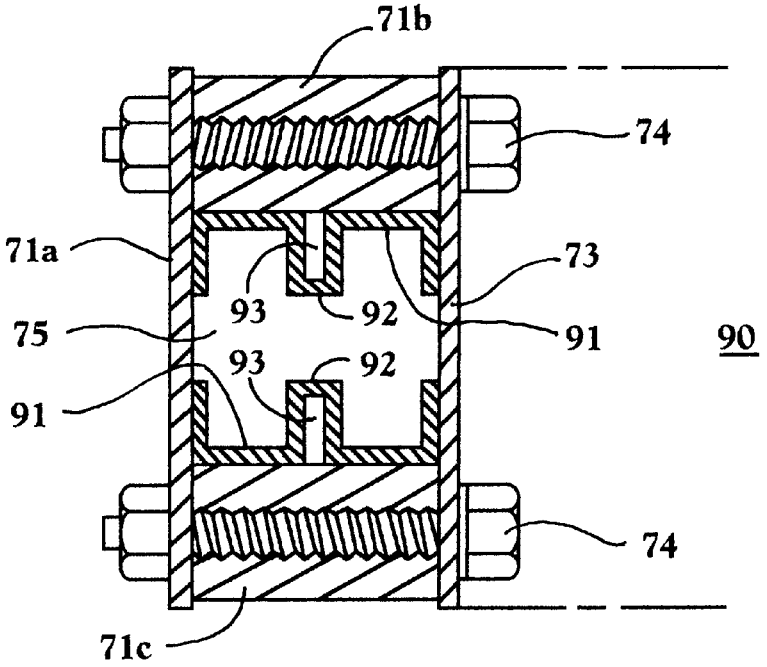

The leak preventive structure for a case of a surface combustion burner of the present invention can also be embodied as shown in FIG. 13. In the circularly installed surface combustion burner 90 shown in FIG. 13, the top 71*b* and the bottom 71*c* are covered, on the premixture introducing space 75 side, with a metallic sheet 91 having a means for preventing thermal expansion, to keep the top 71*b* and the bottom 71*c* gas-tight. That is, each of the metallic sheets 91 has a thermal expansion absorbing portion 92 protruded toward the center of the premixture introducing space 75 formed between the top 71*b* and the bottom 71*c* respectively covered with the metallic sheet 91, in the circumferential direction of the premixture introducing space. Each of the respective thermal expansion absorbing portions 92 contains an absorbing space 33 on the top 71*b* or bottom 71*c* side. A plurality of thermal expansion absorbing portions 92 may also be provided for each side. The thermal expansion absorbing portions 92 can also be formed in the circumferential direction of the premixture introducing space 75, or in the direction perpendicular to the circumferential direction of the premixture introducing space 75 in stripes. The forms of the thermal expansion absorbing portions 92 can be selected as desired.

Figure 14:
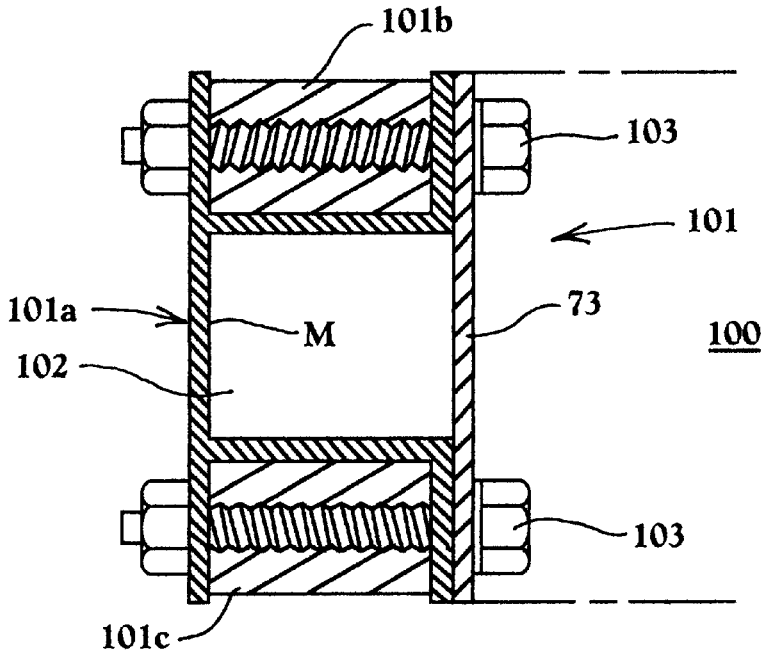

The leak preventive structure for a case of a surface combustion burner of the present invention can also be embodied as shown in FIG. 14. In the circularly installed surface combustion burner 100 shown in FIG. 14, the peripheral wall 101*a* of the case 101 and the surfaces of the ceramic fibers forming the top 101*b* and the bottom 101*c* on the premixture introducing space 102 side are integrally formed by a metallic sheet M. The surfaces of the top 101*b* and the bottom 101*c* on the cylindrical space side at the center of the case 101 are also covered with the metallic sheet M.

The burner element 73 is immobilized by bolts 103 at the top 101*b* and the bottom 101*c* from the cylindrical space side.

According to this structure, since the premixture introducing space 102 of the case 101 is surrounded by the metallic sheet M, the leak of premixture from the top 101*b* and the bottom 101*c* can be prevented, and the premixture is discharged only from the burner element 73, to allow the surface combustion of the entire burner element 73.

Figure 15:
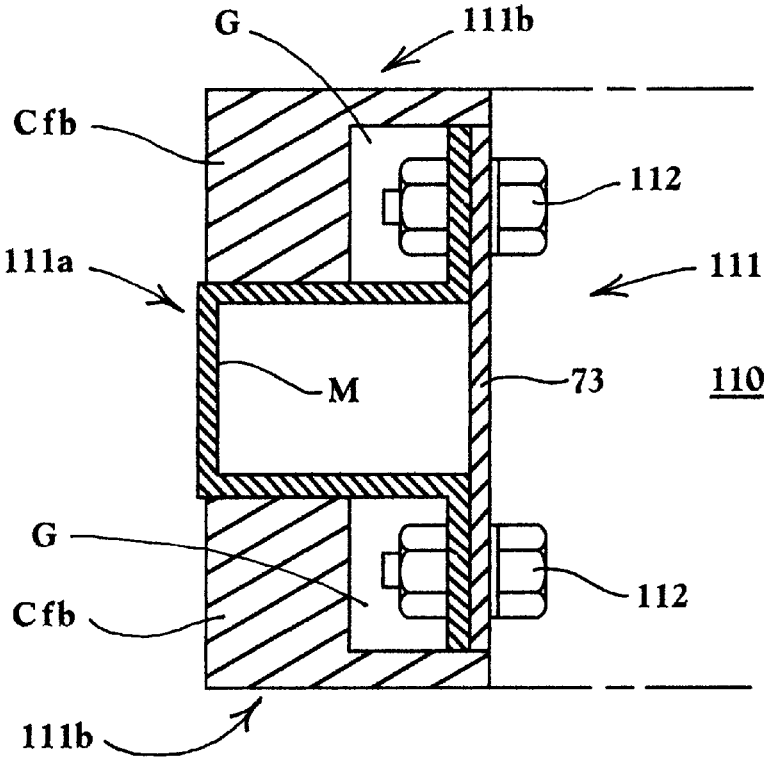

The leak preventive structure for a case of a surface combustion burner of the present invention can also be embodied as shown in FIG. 15. In the circularly installed surface combustion burner 110 shown in FIG. 15, the peripheral wall 111*a* of the case 111 and the top 111*b* and the bottom 111*c* are integrally formed by a metallic sheet M, and the metallic sheet M is extended to the top 111*b* and the bottom 111*c* to which the burner element 73 is attached. The burner element 73 is immobilized by bolts 112 from the cylindrical space side.

The top 111*b* and the bottom 111*c* around the bolts 112, to which the burner element 73 is attached, are formed by covering ceramic fibers C fb. In this case, between each of the bolts 112 and the corresponding ceramic fibers C fb, a small space G is formed.

According to this structure, gas-tightness can be, of course, secured, and the structure of the case 111 can be simplified. Furthermore, since the small spaces G around the bolts 112 where the burner element 73 as a heating element is attached to the top 111*b* and the bottom 111*c* can inhibit heat transfer, the adverse effects of thermal expansion can be effectively prevented.

Figure 16:
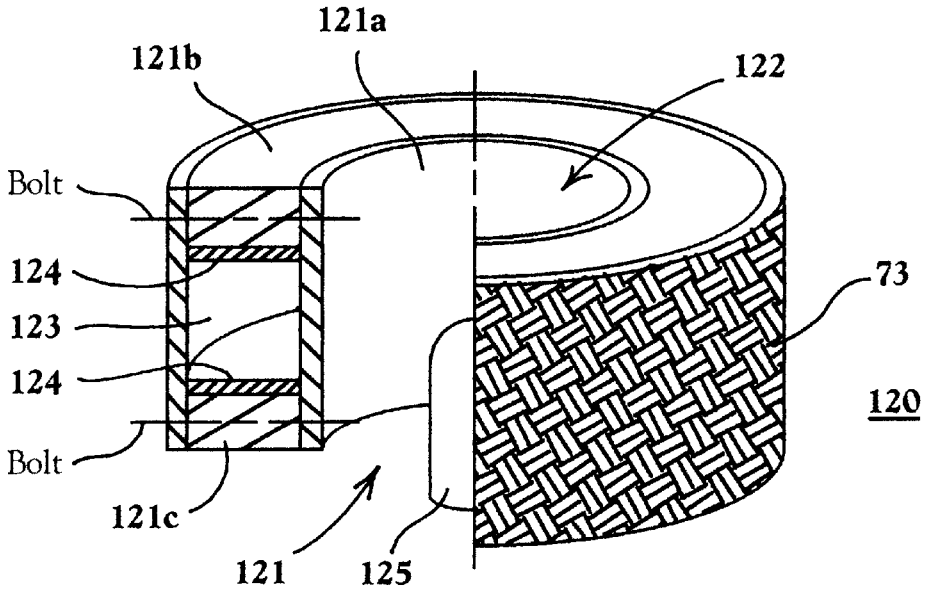

The leak preventive structure for a case of a surface combustion burner of the present invention can also be embodied as shown in FIG. 16. In the circularly installed surface combustion burner 120 shown in FIG. 16, the burner element 73 is installed as the peripheral wall of the case 121. That is, in the circularly installed surface combustion burner 120, the case 121 is cylindrical in external form as in the previous embodiment, but the peripheral wall 121*a* of the cylindrical space 122 at the center of the case is formed by a metallic sheet, while the top 121*b* and the bottom 121*c* formed by ceramic fibers form the premixture introducing space 123. The top 121*b* and the bottom 121*c* are coated with a sealant 124 such as a coating cement on the surfaces facing the premixture introducing space 123. The sealant 124 can also be impregnated into the ceramic fibers forming the top 121*b* and the bottom 121*c* beforehand.

The burner element 73 is installed around the case 121, to form the peripheral wall of the case 121, and immobilized by bolts to the top 121*b* and the bottom 121*c* from outside. In the circularly installed surface combustion burner 120, the premixture is introduced into the premixture introducing space 123 from the premixture supply pipe 125 provided in the peripheral wall 121*a* of the cylindrical space 122 at the center of the case.

Also in the circularly installed surface combustion burner 120, the ceramic fibers used to form the top 121*b* and the bottom 121*c* can also be covered with a metallic sheet on the surfaces facing the premixture introducing space 123. Furthermore, the top 121*b* and the bottom 121*c* can also be partially coated with a sealant.

When the top 121*b* and the bottom 121*c* are covered with a metallic sheet on the ceramic fiber surfaces facing the premixture introducing space 123, the metallic sheet can also be provided with a means for preventing thermal expansion.

Furthermore, the leak preventive structure can also be arranged in such a manner that the top 121*b* and the bottom 121*c* are covered on the ceramic fiber surfaces facing the premixture introducing space 123, that the metallic sheet is extended to the peripheral wall of the case 121 at the top 121*b* and the bottom 121*c* where the burner element 73 is attached, that the burner element 73 and the metallic sheet are fastened by bolts, and that a space is formed between the burner element attaching portion and the top 121*b* or the bottom 121*c* respectively.

According to the circularly installed surface combustion burner 120 as described above, the adverse effects of thermal expansion can be prevented, and the premixture introducing space 123 can be kept gas-tight at any other portions than the burner element 73. On the other hand, since the burner element 73 is arranged as the peripheral wall of the case for heating on the outside, the burner can be used as a heat source of heaters for special applications.

Figure 17:
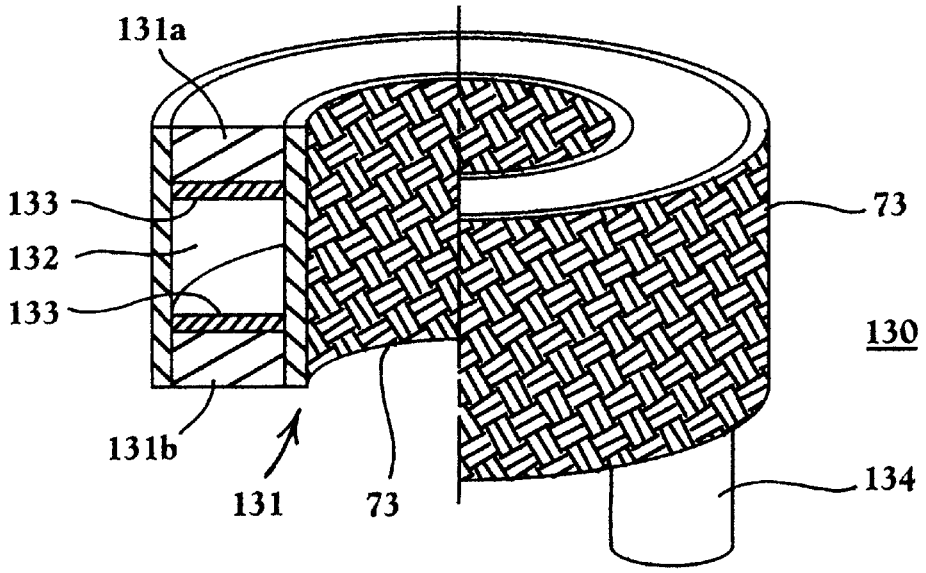

The leak preventive structure for a case of a surface combustion burner of the present invention can also be embodied as shown in FIG. 17. In the circularly installed surface combustion burner 130 shown in FIG. 17, a burner element 73 is installed as the peripheral wall of the case 131 and another burner element 73 is installed as the peripheral wall of the cylindrical space at the center of the case, for heating on both sides. Furthermore, the top 131*a* and the bottom 131*b* forming the premixture introducing space, are formed by ceramic fibers, and the ceramic fibers are coated with a sealant 133 on the surfaces facing the premixture introducing space 132. The sealant 133 can also be impregnated into the ceramic fibers beforehand. Furthermore, the ceramic fibers can also be covered with a metallic sheet on the surfaces facing the premixture introducing space 132. The ceramic fibers can also be coated with a sealant partially on their inside surfaces.

In the circularly installed surface combustion burner 130, the premixture supply pipe 134 is attached to the bottom 131*b*, to introduce the premixture into the premixture introducing space 132.

The top 131*a* and the bottom 131*b* can also be covered with a metallic sheet having a means for preventing thermal expansion on the ceramic fiber surfaces facing the premixture introducing space 132.

Furthermore, the leak preventive structure can also be arranged in such a manner that the metallic sheet covering the ceramic fiber surfaces facing the premixture introducing space 132 is extended to the peripheral wall of the case and the peripheral wall of the cylindrical space at the top 131*a* and the bottom 131*b* where the burner elements 73 are attached, that the burner elements 73 and the metallic sheets on both sides are fastened by bolts, and that a space is formed between the burner element attaching portion and the top 131*a* or the bottom 131*b* respectively on both sides.

In the circularly installed surface combustion burner 130 as described above, the adverse effects of thermal expansion can be prevented, and the premixture introducing space 132 can be kept gas-tight at any other portions than the burner elements 73. On the other hand, since the burner elements 73 are arranged as the peripheral wall of the cylindrical heater 131 and as the peripheral wall of the cylindrical space at the center of the case, for heating on both sides, the burner can be applied as a heat source for a wider range of various heaters.

The leak preventive structure for a case of a surface combustion burner of the present invention can also be applied to a circularly installed surface combustion burner installed in a cylindrical case as shown in FIG. 18.

The circularly installed surface combustion burner 140 has a cylindrical case 141, and the top 141*a* and the bottom 141*b* of the cylindrical case 141 are formed by ceramic fibers, while a burner element 73 formed by a fiber mat is installed along the peripheral wall of the cylindrical case 141. The top 141*a*, the bottom 141*b* and the burner element 73 form a premixture chamber 142.

The top 141*a* and the bottom 141*b* are coated with a sealant 143 on the surfaces facing the premixture chamber 142. The sealant 143 can also be impregnated into the surfaces of the top 141*a* and the bottom 141*b* beforehand (see FIG. 19).

The bottom 141*b* is provided with a premixture supply pipe 144 for supplying the premixture into the premixture chamber 142.

This structure prevents the leak of the premixture from the surfaces of the top 141*a* and the bottom 141*b* other than the burner element 73.

Since the cylindrical case 141 of the circularly installed surface combustion burner 140 is simply cylindrical, the structure can be further simplified, and the leak preventive measure can also be taken more easily (see FIG. 19). This advantage is available also when the case is prismatic, instead of being cylindrical.

Also in the circularly installed surface combustion burner 140 with a simple cylindrical case, the following various versions can be adopted for the leak preventive structure, though they are not illustrated as drawings.

For example, the burner 73 can be formed by a fire resistant porous mat.

Furthermore, in the circularly installed surface combustion burner 140, the top 141*a* and the bottom 141*b* can also be covered with a metallic sheet, instead of being coated with the sealant 143, on the surfaces facing the premixture chamber 142.

Moreover, the top 141*a* and the bottom 141*b* can also be covered with a metallic sheet partially on the surfaces and coated with a sealant at least on the other surfaces.

The metallic sheet used to cover the surfaces of the top 141*a* and the bottom 141*b* can also be provided with a means for preventing thermal expansion.

Furthermore, in the circularly installed surface combustion burner 140, the metallic sheet used to cover the top 141*a* and the bottom 141*b* on the surfaces facing the premixture chamber 142 can be extended to the peripheral wall at the portions where the burner element 73 is attached, and the metallic sheet and the burner element 73 can be fastened by clamping means. In this structure, a space is formed between the burner element attaching portions and the top or bottom of the case respectively as a means for preventing thermal expansion.

The leak preventive structure for a case of a surface combustion burner of the present invention has been described in reference to several embodiments of a circularly installed surface combustion burner. In these embodiments, if a packing can be provided between the burner element constituting the burner and the metallic sheet, and/or between the burner element and the ceramic fibers, and/or between the case and the ceramic fibers, or if clamping means such as washers can be used for the bolts used to immobilize the burner element, the leak of premixture from any other portions than the burner element can be prevented more reliably.

[Effects of the invention]

The present invention adopts a structure in which heat resistant, highly heat insulating and inexpensive ceramic fibers are held in positions, to inhibit thermal expansion, and since the inside surface (facing the premixture supply space) of the surface combustion burner element is exposed to relatively low temperature and less likely to be affected by the flame, the lateral walls formed by ceramic fibers can be coated, on their inside surfaces, with a sealant or covered with a metallic sheet, etc., to be kept gas-tight, for preventing the leak of fuel and premixture from any other portions than the burner element.

| | |
|---|---|
| 11 | burner element |
| 12 | case |
| 13 | bottom plate |
| 14 | lateral wall |
| 15 | bolt and nut |
| 16 | supply port |
| 17 | premixture supply pipe |
| 18 | sealant |
| 21, 31, 42, 52 | metallic sheet |
| 32 | thermal expansion absorbing portion |
| 33 | absorbing space |
| 41, 51, 61 | case |
| 41a, 51a, 62 | lateral wall |
| 41b, 51b | bottom plate |
| 53 | space |
| 54 | bolt |
| 63 | premixture supply pipe |
| 70, 80, 90 | circularly installed surface combustion burner |
| 100, 110, 120, 130 | circularly installed surface combustion burner |
| 71 | case |
| 71a | peripheral wall of case |
| 71b | top |
| 71c | bottom |
| 72 | space |
| 73 | burner element |
| 74 | bolt |
| 75 | premixture introducing space |
| 76 | premixture supply pipe |
| 77 | sealant |
| 81, 91 | metallic sheet |
| 92 | thermal expansion absorbing portion |
| 93 | absorbing space |
| 101, 111, 121 | case |
| 101a, 111a | peripheral wall of case |
| 101b, 111b, 121b | top |
| 101c, 111c, 121c | bottom |
| 102, 123, 132 | premixture introducing space |
| 103, 112 | bolt |
| 121a | peripheral wall of cylindrical space |
| 123, 132 | premixture introducing space |
| 124, 133 | sealant |
| 125 | premixture supply pipe |
| 132a | top |
| 132b | bottom |
| 140 | circularly installed surface combustion burner |
| 141 | case |
| 141a | top |
| 141b | bottom |
| 142 | premixture burner |
| 143 | sealant |
| 144 | premixture supply pipe |

What is claimed is:

1. A leak preventive structure for a case of a flatly installed surface combustion burner, in which a fiber mat as a burner element is installed flatly in a case, characterized in that said case has an open face and uses ceramic fibers to form its lateral walls, that said open face is closed by the burner element immobilized there, and that the lateral walls are coated with a sealant on the surfaces facing the inside of the case.

2. The leak preventive structure of claim 1, wherein the mat is a fire resistant porous mat.

3. The leak preventive structure of claim 1, wherein the lateral walls are impregnated with a sealant beforehand on the surfaces facing the inside of the case.

4. The leak preventive structure of claim 2, wherein the lateral walls are impregnated with a sealant beforehand on the surfaces facing the inside of the case.

5. The leak preventive structure of claim 1, wherein the ceramic fibers are covered with at least one metallic sheet on the surfaces facing the inside of the case.

6. The leak preventive structure of claim 2, wherein the ceramic fibers are covered with at least one metallic sheet on the surfaces facing the inside of the case.

7. The leak preventive structure of claim 1, wherein the ceramic fibers are covered with at least one metallic sheet partially on the surfaces facing the inside of the case, and coated with a sealant at least on the other portions of the surfaces.

8. The leak preventive structure of claim 2, wherein the ceramic fibers are covered with at least one metallic sheet partially on the surfaces facing the inside of the case, and coated with a sealant at least on the other portions of the surfaces.

9. The leak preventive structure of claim 5, wherein the metallic sheet is provided with a means for compensating for thermal expansion.

10. The leak preventive structure of claim 1, wherein the case has an open face for installing the burner element, and has its walls covered with at least one metallic sheet on the surfaces facing the inside of the case, and that the regions surrounding the portions where the burner element is attached are covered with ceramic fibers.

11. The leak preventive structure of claim 2, wherein the case has an open face for installing the burner element, and has its walls covered with at least one metallic sheet on the surfaces facing the inside of the case, and the regions surrounding the portions where the burner element is attached are covered with ceramic fibers.

12. The leak preventive structure of claim 1, wherein a pair of opposite sides of the case are provided as open faces, burner elements are installed in the open faces.

13. The leak preventive structure of claim 2, wherein a pair of opposite sides of the case are provided as open faces, burner elements are installed in the open faces.

14. The leak preventive structure of claim 12, wherein said other walls are impregnated with a sealant beforehand on the inside surfaces.

15. The leak preventive structure of claim 13, wherein said other walls are impregnated with a sealant beforehand on the inside surfaces.

16. The leak preventive structure of claim 12, wherein said other walls are covered with at least one metallic sheet on the inside surfaces.

17. The leak preventive structure of claim 13, wherein said other walls are covered with at least one metallic sheet on the inside surfaces.

18. The leak preventive structure of claim 12, wherein said other walls are covered with at least one metallic sheet partially on the inside surfaces and coated with a sealant at least on the other portions of the surfaces.

19. The leak preventive structure of claim 13, wherein said other walls are covered with at least one metallic sheet partially on the inside surfaces and coated with a sealant at least on the other portions of the surfaces.

20. The leak preventive structure of claim 16, wherein the metallic sheet in the case is provided with a means for accomodating thermal expansion.

* * * * *